United States Patent [19]

Kakizoe et al.

[11] Patent Number: 5,055,811

[45] Date of Patent: Oct. 8, 1991

[54] ELECTROMAGNETIC APPARATUS

[75] Inventors: Masahiro Kakizoe; Shigeharu Ootsuka, both of Nagoya, Japan

[73] Assignee: Mitsubishi Denki Kabushiki Kaisha, Chiyoda, Japan

[21] Appl. No.: 518,470

[22] Filed: May 3, 1990

[30] Foreign Application Priority Data

Nov. 7, 1989 [JP] Japan ..... 1-289578

[51] Int. Cl.[5] ..... H01H 7/00

[52] U.S. Cl. ..... 335/59; 335/131

[58] Field of Search ..... 335/131-132, 335/202, 6, 59-65

[56] References Cited

U.S. PATENT DOCUMENTS 4,009,457 2/1977 Guery et al. ..... 335/132
4,181,829 1/1980 Selas .
4,303,147 12/1971 Selas et al. ..... 335/61

FOREIGN PATENT DOCUMENTS 268429 2/1969 Austria .
3540460 5/1987 Fed. Rep. of Germany .
2846955 10/1988 Fed. Rep. of Germany .
58-18728 4/1983 Japan .
60-26157 2/1985 Japan .
61-224231 10/1986 Japan .

*Primary Examiner*—Leo P. Picard
*Assistant Examiner*—Lincoln Donovan
*Attorney, Agent, or Firm*—Burns, Doane, Swecker & Mathis

[57] ABSTRACT

An electromagnetic apparatus has a connecting mechanism which transmits the operation of an actuator (28) of a main body to electric contact parts (13, 14) of a time delay unit 34 mounted on the main body. The connecting mechanism comprises a movable frame (31, 41, 51) for making the open/close operation of the electric contact parts (13, 14), and a connecting bar (30,60, 70) for connecting between the actuator (28) and the movable frame (31, 41, 51). The connecting bar (30, 60, 70) detachably engages with the actuator (28) and is connected to the movable frame (31, 41, 51) through a spring (32) which adjusts difference of operation stroke when the actuator (28) is moved over the operation stroke of the movable frame (31, 41, 51).

4 Claims, 14 Drawing Sheets

ELECTROMAGNETIC APPARATUS

FIELD OF THE INVENTION

1. Field of the Invention

The present invention relates to an electromagnetic apparatus to be operated by a relay unit, which has an actuating mechanism, such as, an electromagnet and is for driving a time delay unit mounted on the relay unit, so as to make a delay operation for opening or closing contacts in the time delay unit.

2. Description of the Related Art

The following is an explanation of a conventional electromagnetic apparatus taking an example of a conventional time delay unit.

The conventional time delay unit including a timing mechanism and a contact mechanism has been assembled into one unit. And, the time delay unit is mounted on a main relay unit so as to be easily removed from the main relay unit. Examples of such a time delay unit are shown in Japanese Official Gazette of examined Patent Publication No. Sho 58-18728 and U.S. Pat. No. 4,181,829.

U.S. Pat. No. 4,181,829 discloses a pneumatic type time delay unit which is mounted on the main relay unit. The main relay unit which is a main body of an electromagnetic switch actuates the time delay unit. When the main relay unit is actuated, the electric contact parts of the time delay unit are moved instantly to either open or close. When the main relay unit is kept in its drop-away condition, namely, the main relay unit is deenergized, the electric contact parts are moved to either close or open after predetermined time passed. The time delay unit including the timing mechanism is detachably engaged with the main relay unit, and the time delay unit is operated together with the main relay unit like one body.

The conventional time delay unit having a time delay operation comprises: a bellows unit for making the time delay operation; crossbars for making movable contacts to open state and closed state after lapse of predetermined time from the main relay units becoming a drop away condition; and a movable frame which is connected to the crossbars for transmitting the operation of an actuator. The actuator which is provided on the main relay unit is operated when an electromagnetic coil of the main relay unit is energized. The operation of the actuator of the main relay unit is transmitted to the movable contact of the time delay unit, which is mounted on the main relay unit.

In the above-mentioned conventional time delay unit, the movable frame, which moves to crossbar in the compression direction of the bellows, is engaged to connect with the actuator. The crossbar slidably supports the movable contact for turning open or closed state when the main relay unit is actuated. There is a case that the conventional time delay unit can not be used in other main relay unit whose actuator has a long operation stroke which is longer than the operation stroke of the movable frame of the time delay unit. If the time delay unit is mounted on this main relay unit having the long operation stroke, special parts for adjusting the difference strokes must be provided. An example of such a main relay unit having the adjustment mechanism for the different strokes are shown in Japanese Official Gazette of unexamined Patent Publication No. Sho 60-26157. This example discloses that a crossbar of an auxiliary contact is mounted through a spring on a main relay unit. But this example of the main relay unit needs a lot of time for an assembling step for manufacture of it. And, it is difficult that the auxiliary contact is accurately fixed in the assembling step to correspond with the actuators having the difference of operation strokes.

OBJECT AND SUMMARY OF THE INVENTION

An object of the present invention is to provide an electromagnetic apparatus having a timing mechanism which can be operated by actuators of electromagnetic apparatus having various operation strokes.

In order to achieve the above-mentioned object, the electromagnetic apparatus of the present invention comprises:

a main body of the electromagnetic apparatus having an actuator which is magnetically operated; and a unit which is detachably mounted to the main body of electromagnetic apparatus, and which comprises:

(a) contact means, (b) a movable body which is moved by the actuator and which operates the contact means in the predetermined open or close operation, and (c) a connecting member for connection between the actuator and the movable body, whose one end is detachably engaged with the actuator and the other end is connected to the movable body through stroke adjusting means which adjust difference of stroke when the actuator is moved over the operation stroke range of the movable body.

While the novel features of the invention are set forth particularly in the appended claims, the invention, both as to organization and content, will be better understood and appreciated, along with other objects and features thereof, from the following detailed description taken in conjunction with the drawings.

BRIEF DESCRIPTION OF THE DRAWINGS

FIG. 1 is a perspective view showing a part of the electromagnetic apparatus of the present invention.

FIG. 2 is a cross-sectional side view showing a time delay unit in a drop-way condition before a main relay unit of the electromagnetic apparatus is actuated.

FIG. 3 is a cross-sectional side view showing the time delay unit in a holding condition when the main relay unit having a short operation stroke has finished the setting operation.

FIG. 4 is a cross-sectional side view showing the time delay unit in the holding condition when the main relay unit having a long operation stroke has finished the close operation.

FIG. 5 is a cross-sectional side view showing the time delay unit in the drop-away condition when the main relay unit is moved from the condition shown in FIG. 4.

FIG. 6 is a plan view showing the disc plate.

FIG. 7 is a cross-sectional side view showing a time delay unit in a drop-away condition before a main relay unit of the electromagnetic apparatus is actuated.

FIG. 8 is a cross-sectional side view showing the time delay unit in a setting operation when a connecting bar is slid for a predetermined interval by the actuated main relay unit.

FIG. 9 is a cross-sectional side view showing the time delay unit in a holding condition when the main relay unit has finished the setting operation shown in FIG. 8.

FIGS. 10(*a*), 10(*b*) and 10(*c*) are perspective views showing a connection mechanism for mounting the time delay unit.

FIG. 11 is a cross-sectional side view showing a time delay unit in a drop-away condition before a main relay unit of the electromagnetic apparatus is actuated.

FIG. 12 is a cross-sectional side view showing the time delay unit in a setting operation when a connecting bar is slid for a predetermined interval by the actuated relay unit.

FIG. 13 is a cross-sectional side view showing a time delay unit in a holding condition when the main relay unit has finished the setting operation shown in FIG. 12.

It will be recognized that some or all of the Figures are schematic representations for purposes of illustration and do not necessarily depict the actual relative sizes or locations of the elements shown.

DESCRIPTION OF THE PREFERRED EMBODIMENTS

Hereafter, preferred embodiments of the present invention are described with reference to the accompanying drawings of FIGS. 1 to 13.

FIRST EMBODIMENT

Figure 1:
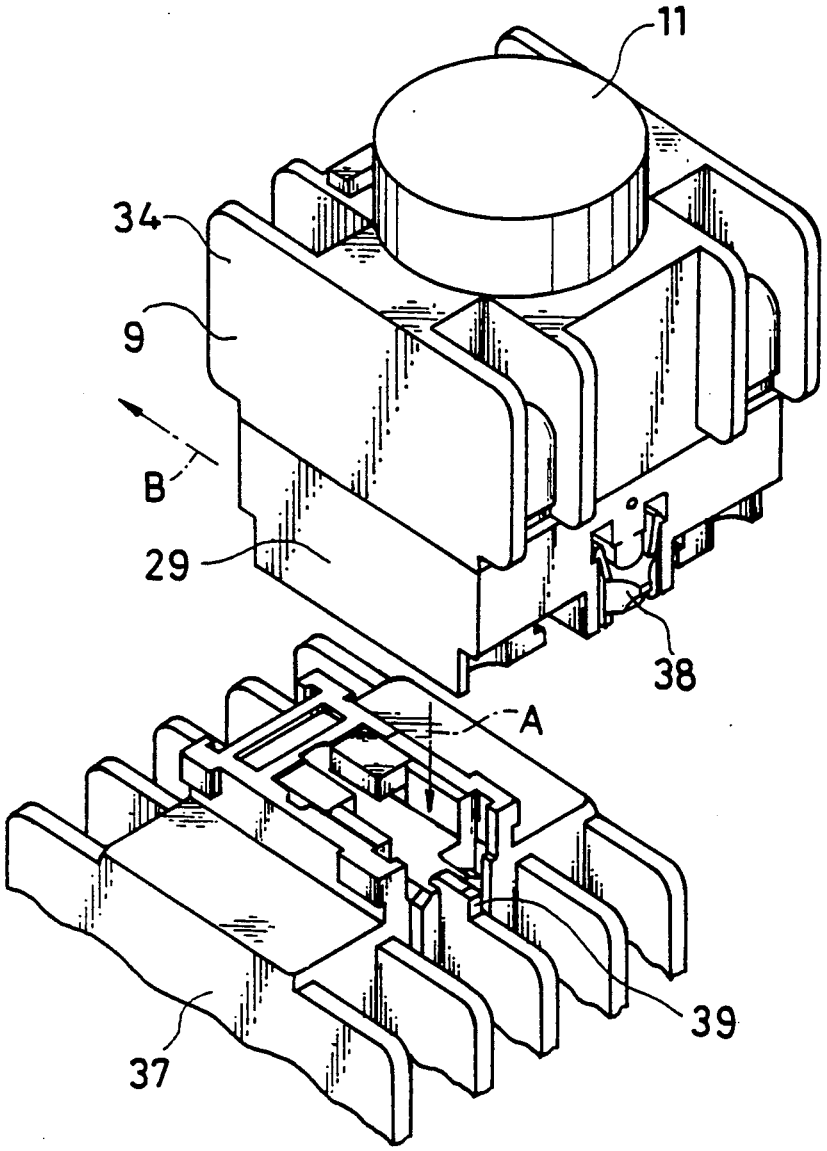
FIGS. 1 to 6 show a first embodiment of an electromagnetic apparatus of the present invention.

FIGS. 1 to 6 show a first embodiment of an electromagnetic apparatus of the present invention. FIG. 1 is a perspective view showing a part of an electromagnetic apparatus of the present invention. A base 29 of the time delay unit 34 is mounted on a main body of the main relay unit 37, such as, a magnetic contactor. An unit stopper 38 is provided on the lower part of the side face of the time delay unit 34, which is to be engaged with a salience 39 of the main relay unit 37. The time delay unit 34 is installed according to the following steps.

In the first step, the time delay unit 34 is mounted on the head of the main relay unit 37 in a manner to be shifted from the center of the head in direction shown about by an arrow A in FIG. 1.

In the second step, the time delay unit 34 is slid in a direction shown by an arrow B in FIG. 1, until the unit stopper 38 is engaged with the salience of the main relay unit 37.

In the third step, the unit stopper 38 is inserted and press-fitted in a groove for fixing to the main relay unit 37.

Figure 2:
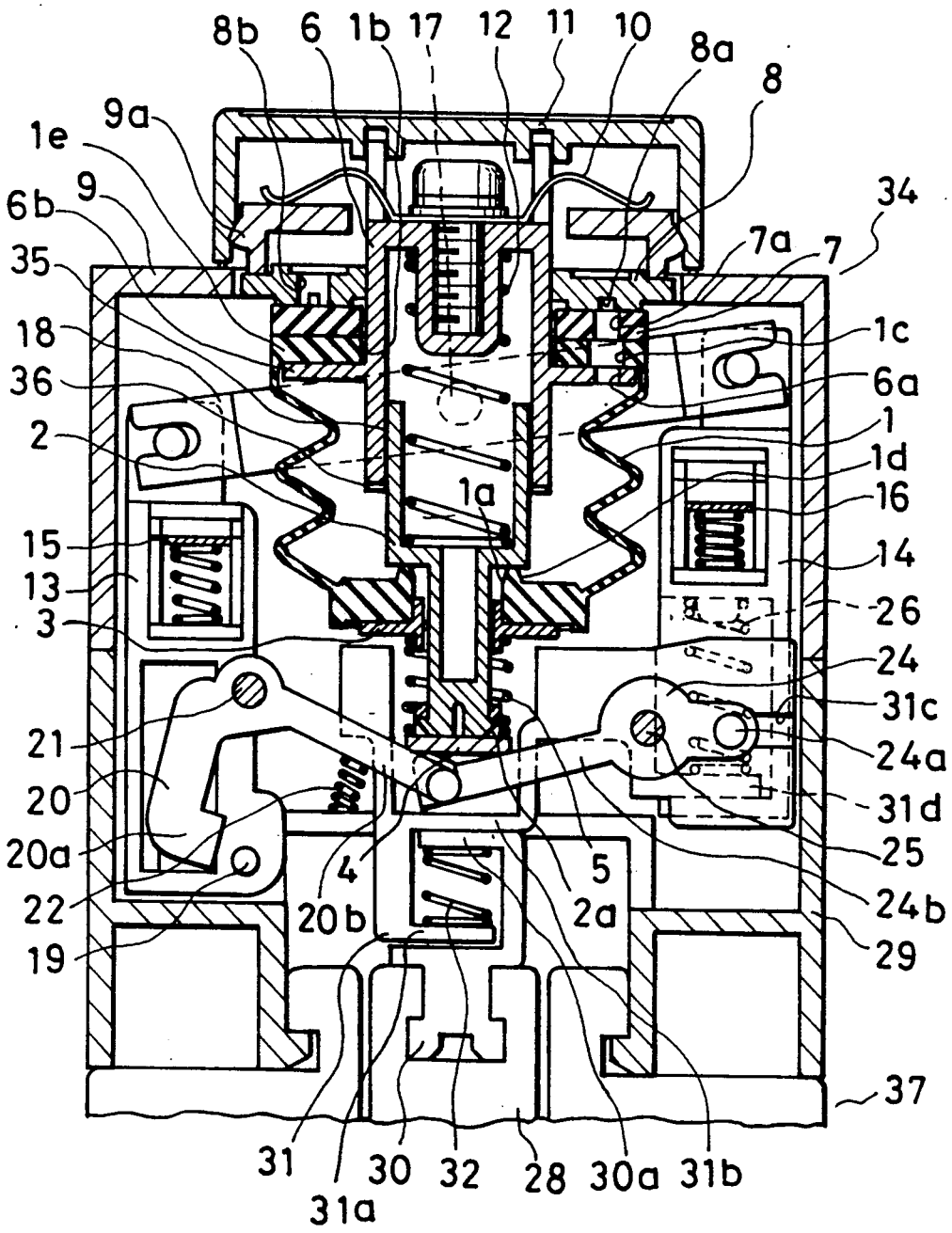
Figure 3:
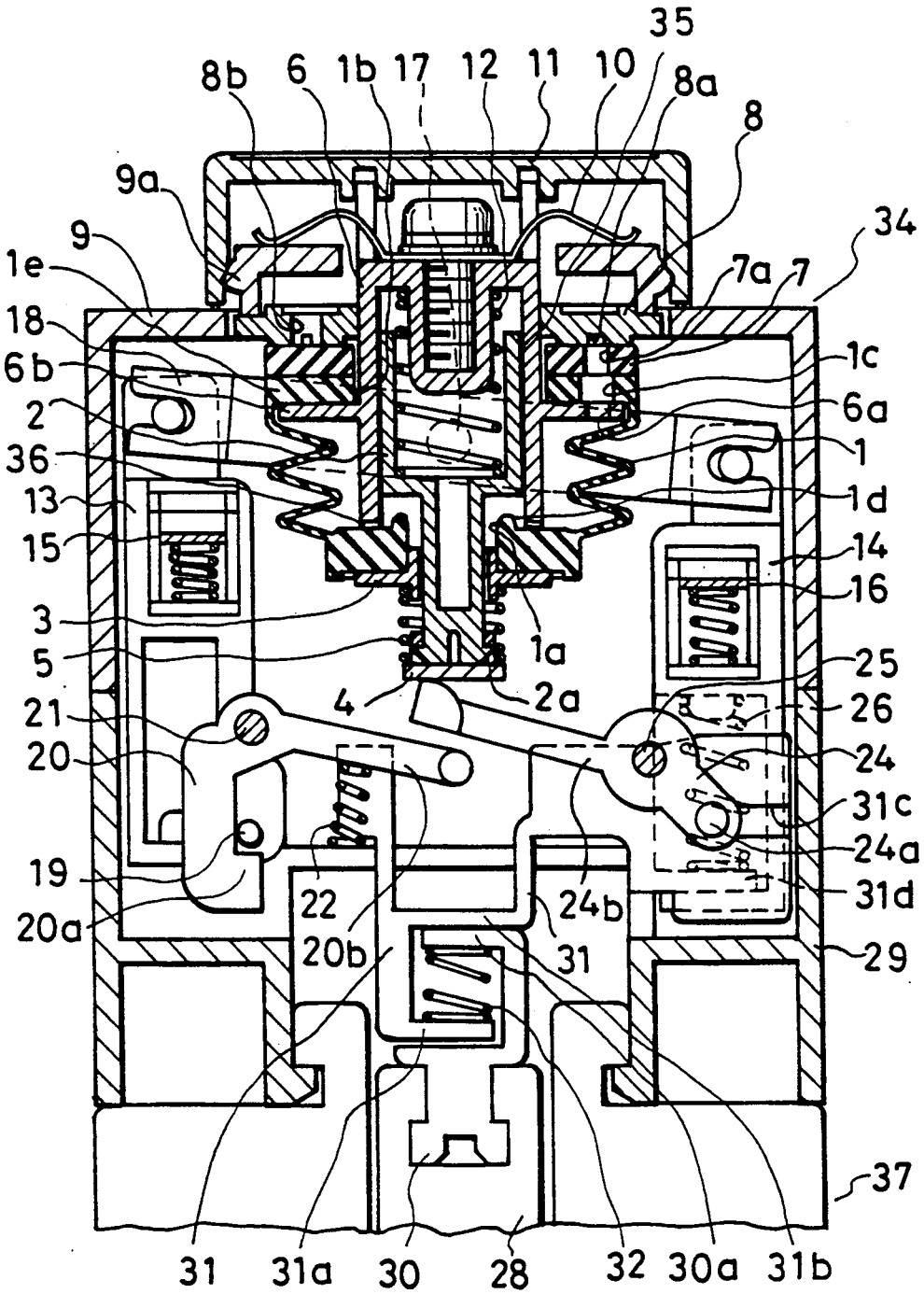
Figure 4:
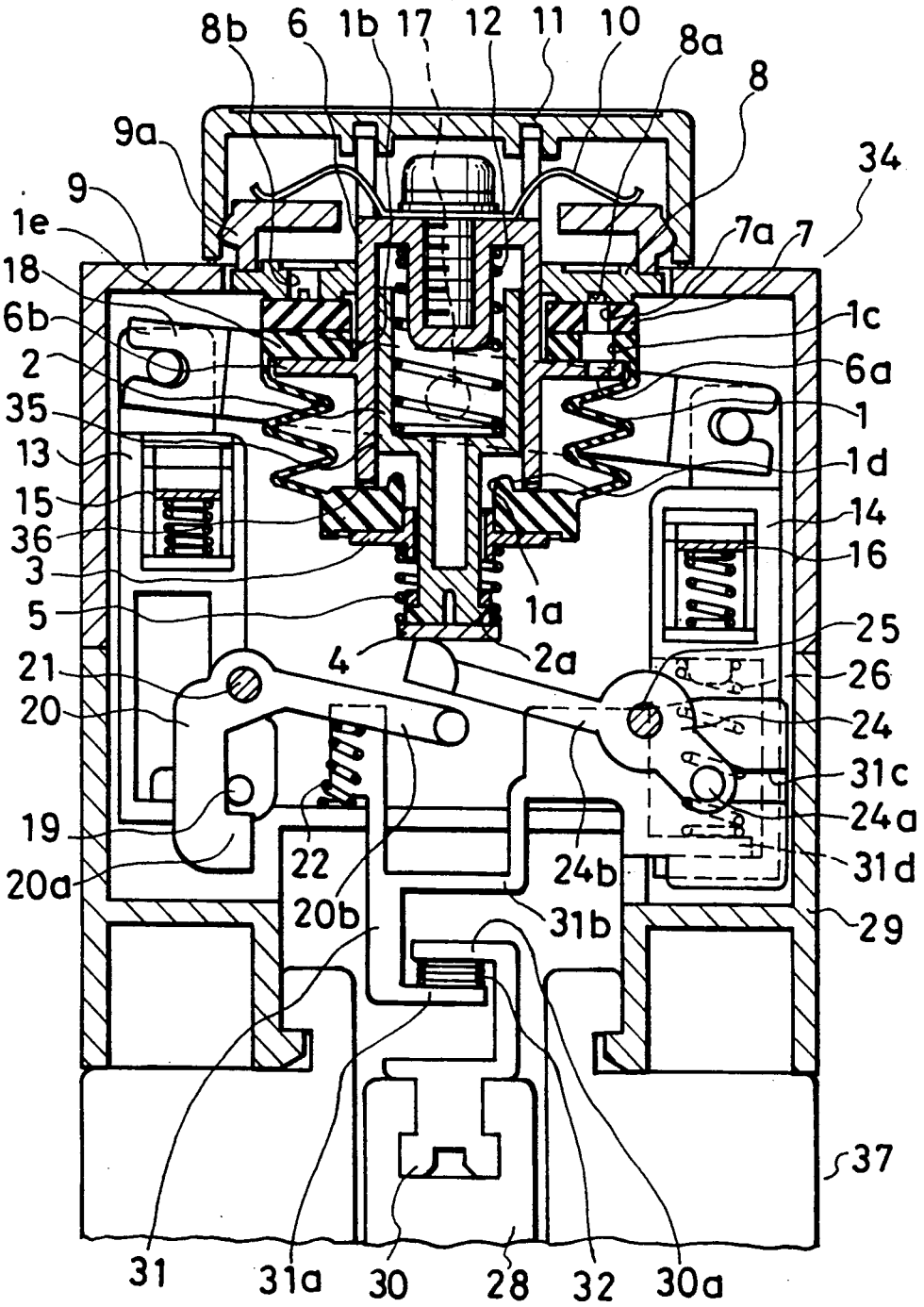
Figure 5:
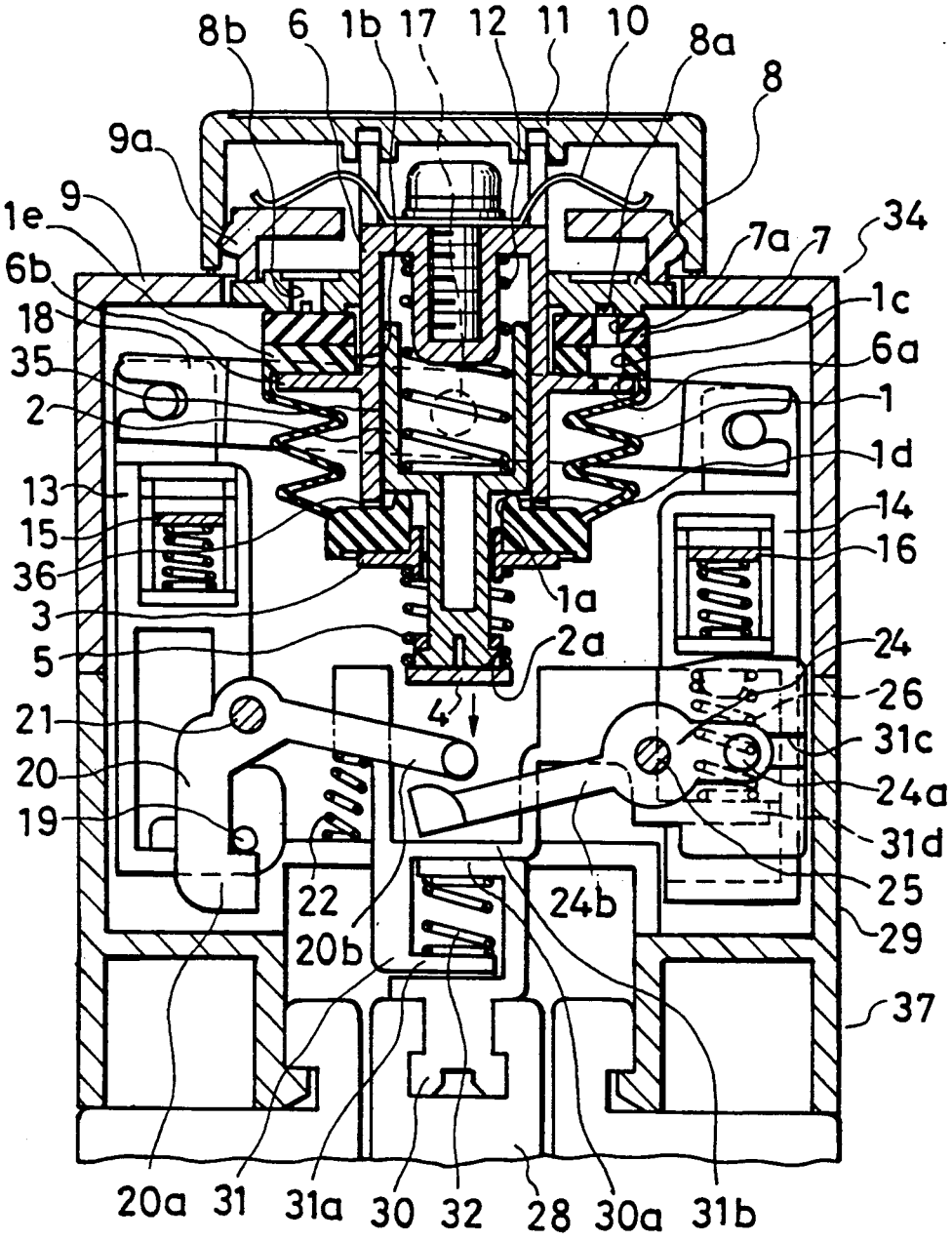
Figure 6:
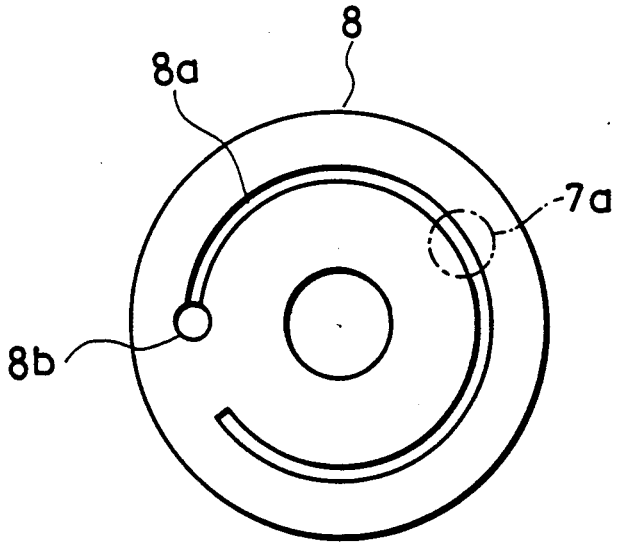

FIG. 2 is a cross-sectional side view showing a time delay unit 34 in a drop-away condition before a main relay unit 37 of the electromagnetic apparatus is actuated. FIG. 3 is a cross-sectional side view showing the time delay unit 34 in a holding condition after the main relay unit 37 having a short operation stroke has finished the setting operation. FIG. 4 is a cross-sectional side view showing the time delay unit 34 in the holding condition after the main relay unit 37 having a long operation stroke has been finished the setting operation. FIG. 5 is a cross-sectional side view showing the time delay unit in the drop-away condition when the main relay unit is moved from the condition shown in FIG. 4. FIG. 6 is a plan view showing the disc plate.

Time Delay Mechanism

FIGS. 2 to 5 show various states of a pneumatic type time delay unit 34 which is mounted on the main relay unit 37. The main relay unit 37 which is a main body of an electromagnetic switch actuates the time delay unit 34. And, each figure shows a time delay operation of the pneumatic time delay unit 34 when the main relay unit 37 is conducted in a drop-away timing operation. When the main relay unit 37 is actuated, the electric contact parts of the time delay unit 34 are moved instantly to either open or close. When the main relay unit 37 is kept in its drop-away condition, namely, the main relay unit 37 is deenergized, the electric contact parts are moved to either close or open after predetermined time passed. The time delay unit 34 including the timing mechanism is detachably engage with the main relay unit 37, and the time delay unit 34 is operated together with the main relay unit 37 like one body. FIG. 4 shows a condition when the setting operation of the timing mechanism have been finished after the main relay unit 37 is actuated. FIG. 5 shows a condition of the timing mechanism when the main relay unit 37 is in the drop-away condition.

In the first place, an operation of a bellows unit for making a timing operation in the time delay unit and an air current control means for introducing to the bellows unit are described. In FIG. 2, a main part of the bellows unit is structured by an elastic bellows 1 which is made of rubber. A lower end and an upper end of the bellows 1 have a lower opening 1*a* and an upper opening 1*b* as shown in FIG. 2, respectively. A through-hole 1*c* for introducing air into the bellows 1 is provided on a flange 1*e* of the upper part where the upper opening 1*b* is formed. A projection 1*d* is provided to protrude upwardly on a circumference edge of the lower opening 1*a* of the bellows 1. A plunger 2 which is provided in the bellows 1 operates a latch lever 20 and a reset lever 24. A guide plate 3, which is fixed to be inserted into the lower opening 1*a* of the bellows 1, slidably supports the plunger 2. A plunger head 4, which is fixed to a bottom end 2*a* of the plunger 2, is provided to push an arm 20*b* of the latch lever 20 and an arm 24*b* of the reset lever 24. A plunger spring 5 is provided between the plunger head 4 and the guide plate 3, whereby the plunger 2 is pressed to closely contact with the projection 1*d* of the bellows 1. As a result, the interior space of the bellows 1 is separated or isolated from the outside space of the bellows 1.

A plunger guide 6 guides the plunger 2 to slide in a direction of an axis of the plunger 2. And the plunger guide 6 has a brim 6*b* which closely contacts with the flange 1*e* where the upper opening 1*b* of the bellows 1 is provided. The brim 6*b* has a first through-hole 6*a* which is provided at the position which faces the above-mentioned through-hole 1*c* of the bellows 1.

A slide plate 7 as a first sliding member, which is made of elastic materials, such as rubber or elastomer, is formed in flat disc shape. The slide pate 7 has a second through-hole 7*a* facing through-hole 1*c* of the bellows 1 for introducing an outside air into the bellows 1.

A disc plate 8 as a second sliding member, which is made of rigid materials, such as plastic or metal, is formed in flat disc shape. As shown in FIG. 6, an air groove 8*a* which is formed in narrow and arc shape is provided on a face of the disc plate 8 for generating a flow resistance when an air passes in the air groove 8*a*. A third through-hole 8*b* of the disc plate 8 for introducing air into the air groove 8a is formed on the end of the air groove 8a of the disc plate 8. The slide plate 7 and the disc plate 8 are mounted on a common axis about the plunger guide 6. The second through-hole 7a of the slide plate 7 is made on the line of the air groove 8a. The disc plate 8 is fixed to a case 9 where the timing mechanism is mounted therein.

A pressure spring 10 is fixed to the top of the plunger guide 6 by a screw as shown in FIG. 2. By pressing of the pressure spring 10, the brim 6b of the plunger guide 6, the bellows 1, the slide plate 7 and the disc plate 8 are pressed to closely contact with each other. As a result, the interior space of the bellows 1 is shut from the outside at these mating surfaces. The plunger guide 6, the bellows 1 and the slide plate 7 are firmly engaged to rotate integrally by a projection (not shown). A knob 11 is rotatable supported by an elastic projection 9a which is provided on the case 9. The slide plate 7 is rotated to slide on the under face of the disc plate 8 by the knob 11. The knob 11 is engaged with the plunger guide 6 to keep the closely contacted between the slide plate 7 and the disc plate 8 even when the knob 11 is moved up or down. And, the only rotation of the knob 11 is transmitted to the slide plate 7 through the bellows 1.

The plunger 2 is always pressed by a bellows spring 12 which is provided in an interior space between the plunger 2 and the plunger guide 6. The bellows spring 12 presses the plunger 2 against resistance which is generated when air flows in the air groove 8a of the disc plate 8. Therefore, the bellows 1 slowly expands for the predetermined time in the time delay operation.

The main structure of the bellows unit comprises the bellows 1, the plunger 2, guide plate 3, plunger head 4, plunger spring 5, plunger guide 6 and bellows spring 12. And, the air current control means for introducing air to the bellows 1 comprise the slide plate 7, disc plate 8, the pressure spring 10 and the knob 11.

Next, the contacts parts having a latch mechanism is described.

Two crossbars 13, 14 slidably support two movable contacts 15, 16, respectively. The crossbars 13, 14 are supported to conduct a seesaw action by a reverse link 18 which is pivoted about a pin 17. The movable contacts 15, 16 are turned open or close to stationary contacts (not shown) by the seesaw action of the reverse link 18. A latch pin 19 is provided on the crossbar 13. A latch lever 20 which is pivotally supported by a pin 21 is upwardly pressed by a latch spring 22. The latch lever 20 comprises an arm 20a which can engage with the latch pin 19 for stopping the movement of the crossbar 13, and the above-mentioned arm 20b whose an end is positioned under the plunger head 4.

A movable frame 31 which is engaged with an actuator 28 is moved by operation of the main relay unit 37. The movable frame 31 has a narrow aperture 31c and a second arm part 31d which contacts with the crossbar 14. A reset lever 24 presses the bellows 1 when the movable frame 31 is moved downward as shown in FIG. 3, and the air chamber in the bellows 1 is set in the starting position of the time delay operation by the reset lever 24. The reset lever 24 has a round bar 24a for engaging with the narrow aperture 31c of a the movable frame 31, and has the arm 24b whose one end is positioned under the plunger head 4. And, the reset lever 24 is pivotally supported by a pin 25. A reverse spring 26 is provided between the second arm part 31d of the movable frame 31 and the crossbar 14. A base 29 which supports the latch mechanism is mounted on the main body of the main relay unit 37. The actuator 28 which is provided in the main relay unit 37 is detachably engaged with the movable frame 31 so as to be moved linearly.

Next, operation of the above-mentioned timing mechanism of the time delay unit 34 shown in FIGS. 2 to 5 is described. In FIG. 2, the main relay unit 37 is in a drop-away condition, that is an electromagnetic coil (not shown) of the main relay unit 37 is not excited. The movable frame 31 is kept by the actuator 28 of the main relay unit 37 at the upper position where the actuator 28 is positioned close to the time delay unit 34. At the time, the bellows 1 is expanded by the bellows spring 12 to the position where the plunger head 4 contacts with the arm 24b of the reset lever 24. The latch lever 20 is also pressed downward by the plunger head 4, and the arm 20a of the latch lever 20 is moved to the position where the arm 20a does not engage with the latch pin 19, as shown in FIG. 2. The crossbar 14 is pressed upward by the reverse spring 26, and the other crossbar 13 is moved downward by the seesaw action of the reverse link 18. As a result, the movable contact 16 is kept in a closed state, and the other movable contact 15 is kept in open state.

FIGS. 3 and 4 show the time delay unit 34 which is in a holding state when the setting operation in the main relay unit 37 has been finished. The following is an explanation of the setting operation in the time delay unit 34. In FIGS. 3 and 4, when the main relay unit 37 is actuated, the movable frame 31 is moved downward by the actuator 28 from the position shown in FIG. 2. The reset lever 24 is rotated clockwise around the pin 25 by engaging the round bar 24a and the narrow aperture 31c of the movable frame 31. As a result, the plunger head 4 is lifted by the arm 24b of the reset lever 24, whereby the bellows 1 is compressed. The bellows 1 is moved to a position where the bellows 1 contacts with the plunger guide 6. However, since the plunger 2 is further pushed up, the plunger 2 is separated from the projection 1d of the bellows 1. As a result, the air chamber in the bellows 1 becomes to lead to outside of the bellows 1 through an aperture 36, which is provided on the plunger guide 6, and a gap 35 between the outside face of the plunger 2 and the inside face of the plunger guide 6. Therefore, it is prevented that the inside pressure of the bellows 1 increases by compressing the bellows 1. At the time, the crossbar 14 is pushed down by the second arm part 31d of the movable frame 31, and the movable contact 16 is turned to an open state. On the other hand, the other crossbar 13 is pushed up by the reverse link 18, and the other movable contact 15 is turned to a closed state. And, the latch pin 19 which is provided on the crossbar 13 is also moved upward. Therefore, the latch pin 19 comes to the position to be able to engage with the arm 20a of the latch lever 20. The latch lever 20 is rotated counterclockwise around the pin 21 by the latch spring 22, when the arm 20b is apart from the plunger head 4. And, the arm 20a of the latch lever 20 engages with the latch pin 19 of the crossbar 13.

When the above-mentioned setting operation have been finished, the time delay unit 34 becomes the condition shown in FIGS. 3 and 4. The time delay unit 34 is kept in this condition while the main relay unit 37 as an operation source is actuating.

The following is an explanation of the operation from the time when the electromagnetic coil of the main relay unit 37 is deenergized and the main relay unit 37 becomes in a drop-away condition, until the time delay operation of the time delay unit 34 has finished. In the condition shown in FIG. 5, when the main relay unit 37 becomes in a drop-away condition, the movable frame 31 is returned by the actuator 28 to the same position as shown in FIG. 2. The reset lever 24 is also returned to the position shown in FIG. 2, since the reset lever 24 is rotated counterclockwise on the pin 25. And, the plunger 2 instantly fell by pressing of the plunger spring 5 and the bellows spring 12, whereby the plunger 2 contacts with the projection 1*d* of the bellows 1. Then, air flowing into inside of the chamber of the bellows 1 through the opening 1*a* is stopped.

After the above-mentioned state, outside air led into the bellows 1 through the air groove 8*a* of the disc plate 8. As a result, the bellows 1 slowly expands, whereby the time delay operation is defined. The time delay operation is conducted by the difference between a force induced by flow resistance in the air groove 8*a* and the return force of the bellows spring 12.

On the other hand, in the above-mentioned circumstance, the crossbar 13 is prevented from sliding downward, because the latch pin 19 of the crossbar 13 is engaged with the arm 20*a* of the latch lever 20 as shown in FIGS. 3 and 4. As a result, the reverse spring 26 is compressed by upwardly moving the second arm part 31*d* of the movable frame 31. The bellows 1 is extended downward after delaying for a predetermined time from the moment from the time when main relay unit 37 becomes in the drop-away condition. After passing of the predetermined time, the plunger head 4 presses the arm 20*b* of the latch lever 20, and the latch lever 20 is rotated clockwise on the pin 21. As a result, the arm 20*a* of the latch lever 20 comes out from the latch pin 19. When the arm 20*a* comes out from the latch pin 19, the time delay unit 34 returns to the same condition as shown in FIG. 2. At the time, the time delay operation has been finished. In other words, crossbars 13, 14 are substantially rotated counter-clockwise by pressing of the reverse spring 26, owing to the latch pin 19 comes off from the arm 20*a*. And, the movable contact 16 turns to the open state, and the other movable contact 15 turns to the closed state. The bellows 1 is stopped downward to expand when the plunger head 4 is contacted with the arm 24*b* of the reset lever 24.

Next, a way of changing the delay time of the time delay unit 34 is described with reference to the accompanying drawings FIG. 2 and FIG. 6. When the knob 11 shown in FIG. 2 is rotated, the plunger guide 6, bellows 1 and the slide plate 7 are rotated integrally to change these arrangement with regard to the disc plate 8. In this operation, the second through-hole 7*a* of the slide plate 7 is rotated to slide along with an arc shape of the air groove 8*a* shown in FIG. 6. Therefore, the effective length of the air groove 8*a* which leads between the third through-hole 8*b* and the second through-hole 7*a* of the slide plate 7 is changed by rotating the knob 11. For example, in case of the long air groove 8*a*, the flow resistance increases, and the extending speed of the bellows 1 is more slow, and the delay time is extended more.

The disc plate 8 is made of a rigid material, such as metal or rigid plastic etc. so as to prevent the change of the sectional form of the air groove 8*a* of the disc plate 8. The slide plate 7 is made of elastic material, such as elastomer or rubber etc. Accordingly, if the rotated slide plate 7 is inclined, or if a fine dust is interposed between the slide plate 7 and the disc plate 8, substantial gap between them does not generate owing to the elastic transformation of the slide plate 7 to minimize the gap. Therefore, air leak from a mating face between them is prevented.

The slide plate 7, which is transformed elastically by the pressure of the pressure spring 10, is closely contacted with the disc plate 8. The predetermined air flow resistance which is made in the air groove 8*a* of the disc plate 8 can be accurately obtained, owing to that the disc plate 8 is made of rigid material and does not change its shape.

Connection Mechanism, Gist of the Invention

In FIG. 2, the base 29 supports the latch mechanism for fixing to the main relay unit 37 of the electromagnetic apparatus. A connecting member, such as, a connecting bar 30, which is detachably engaged with the actuator 28, is moved by the actuated main relay unit 37. The connecting bar 30 has an arm 30*a* (i.e. a second spring receiving member) whose a side view is formed to have an L-shaped as shown in FIG. 2. The movable frame 31 is communicated to the bellows 1 for the timing operation of air chamber and an electric contact part of the time delay relay 34. The movable frame 31 has a first arm part 31*a* (i.e. a first spring receiving member) whose a side view has an L-shape as shown in FIG. 2, and is vertically slidable by the connecting bar 30. The movable frame 31 comprises the first arm part 31*a*, a base end part 31*b*, a narrow aperture 31*c* and a second arm part 31*d* to be engaged with a crossbar 14. A spring 32 as an adjusting means is provided between the end part of the arm 30*a* and the end part of the first arm part 31*a*, and urges compression forces to the arm 30*a* and the first arm 31*a* in opposite directions. The force of the spring 32 is selected little stronger than a total force applied to the movable frame 31. Namely sum of the force of the plunger spring 5 and the force of a spring for pressing the movable contact 16.

Next, operation of the above-mentioned electromagnetic apparatus is described with reference to FIG. 2 to FIG. 3.

In the following, the operation where the time delay unit 34 is mounted on the main relay unit 37 with the actuator 28 having a short operation stroke is described.

In FIG. 2, the main relay unit 37 is kept in a drop-away condition. The connecting bar 30 is held with the actuator 28 at a position close to the bellows unit, namely, at an upper position. And, the end part of the arm 30*a* of the connecting bar 30 directly abuts with the base end part 31*b* of the movable frame 31.

In FIG. 3, the main relay unit 37 is kept in a holding condition after finishing of a setting operation of the main relay unit 37. The actuator 28 and the connecting bar 30 are slid to a lower position from the above-mentioned position in FIG. 2. At the time, the movable frame 31 is slid for the same interval as the movement of the actuator 28 and the connecting bar 30, because the spring 32 has the force which is stronger than the pressure applied to the movable frame 31 by other springs. As above-mentioned, in case where the time delay unit 34 is mounted on the main relay unit 37 with the actuator 28 having a short operation stroke, the connecting bar 30 and the movable frame 31 can be operated by the actuator 28. In this case, the time delay operation is conducted between the conditions shown in FIG. 2 and FIG. 3.

In the following, the operation where the time delay unit 34 is mounted to the main relay unit 37 with an actuator 28 having a long operation stroke is described.

When the main relay unit 37 is in a drop-away condition, the time delay unit 34 is in the same condition as the afore-mentioned state shown in FIG. 2. The time delay unit 34 in a first step of the setting operation is conducted in the same operation as the afore-mentioned state shown in FIG. 3. At this state, however, the setting operation in the main relay unit 37 still is not finished, owing to the long operation stroke of the actuator 28 of the main relay unit 37. This point is different from the case of the aforementioned electromagnetic apparatus having the short operation stroke.

In FIG. 4, the main relay unit 37 is kept in a holding condition when the main relay unit 37 has finished. The actuator 28 and connecting bar 30 are further slid downward from the position shown in FIG. 3. However, the movable frame 31 can not slide downward, since to the movable frame 31 is contacted with the base 29. Therefore, the spring 32 is compressed by the arm 30*a* of the connecting bar 30 and the first arm part 31*a* of the movable frame 31. In other wards, only the three members, namely the actuator 28, the connecting bar 30 and the spring 32, which are shown in FIG. 4, are moved from the position shown in FIG. 3. Accordingly, the movable frame 31 in the setting operation is slid for the same interval as the afore-mentioned movable frame 31, which is moved by the short operation stroke. Therefore, the time delay unit 34, which is mounted on the main relay unit 37 having long operation stroke, can be conducted in the same setting operation as the aforementioned time delay unit 34 having short operation stroke.

As the above-mentioned, in the setting operation shown in FIG. 3 to FIG. 4, only the spring 32 is compressed, and bellows 1 and two crossbars 13, 14 do not operate. And, in the assembling step, the spring 32 is easily provided between the arm 30*a* and the base end part 31*b*, even after the time delay unit 34 is mounted on the main relay unit 37.

In the above-mentioned operation, the movable frame 31 is directly slid to the upper position by the connecting bar 30.

As above-mentioned, in the drop-away condition of the main relay unit 37 shown in FIG. 2, the arm 30*a* of the connecting bar 30 is directly contacted with the base end part 31*b* of the movable frame 31. And, in the holding condition wherein the main relay unit 37 has finished the setting operation, the spring 32 is compressed by the arm 30*a* and the first arm part 31*a*. In the first embodiment, a stroke adjusting adapting means is constructed by the connecting spring, the first spring receiving member of the connecting bar 30 and the second spring receiving member of the movable frame 31, wherein the stroke of the actuator 28 is adapted to move the movable frame 31 a proper amount. Accordingly, the time delay unit 34 in the first embodiment can be operated by the various main relay units having difference operation strokes. Generally, the actuator 28 in the drop-away condition is more exactly provided in comparison with the position in the holding condition, because each position of the actuators in the holding condition is different in accordance with an ability of an electromagnet. As the position of the movable frame 31 is affected to the delay time of the time delay operation, the standard position of the actuator 28 is decided in the drop-away condition of the main relay unit 37. The standard position is the position of the actuator 28 when the connecting bar 30 contacts the movable frame 31 in the drop-away condition. In this first embodiment, the time delay unit 34 can be used for various main relay units having the actuators having the difference operation strokes. This can be made by the provision of the spring 32, the actuator can be moved for appropriate strokes of various main relay units. Further, the shock which is generated by the actuator 28 does not affect the time delay unit directly, owing to the spring 32 for absorbing the shock.

SECOND EMBODIMENT

Next, the second embodiment of the present invention are described with reference of FIG. 7 to FIG. 10(*c*).

Figure 7:
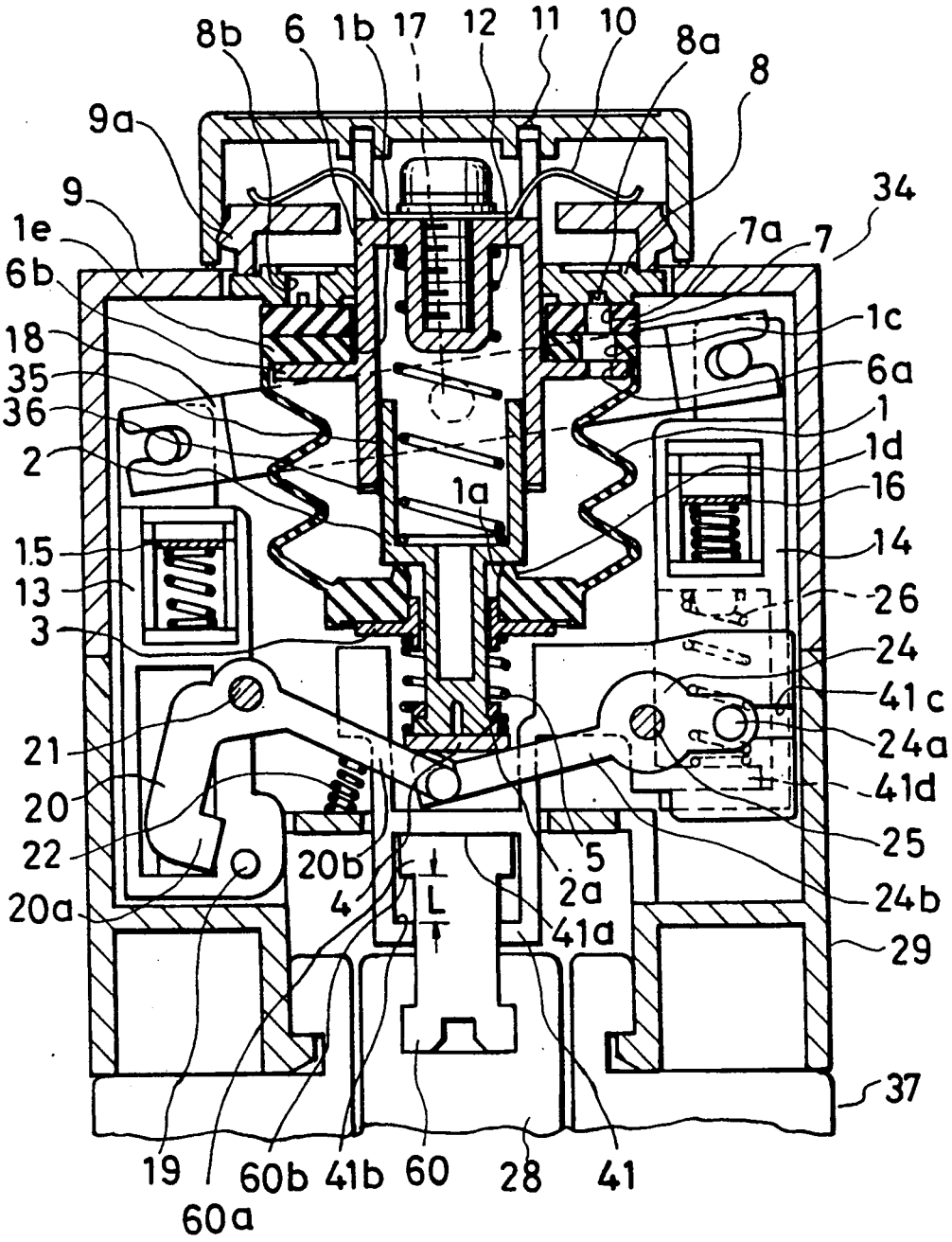
FIGS. 7 to 10(*c*) show a second embodiment of an electromagnetic apparatus of the present invention.
Figure 8:
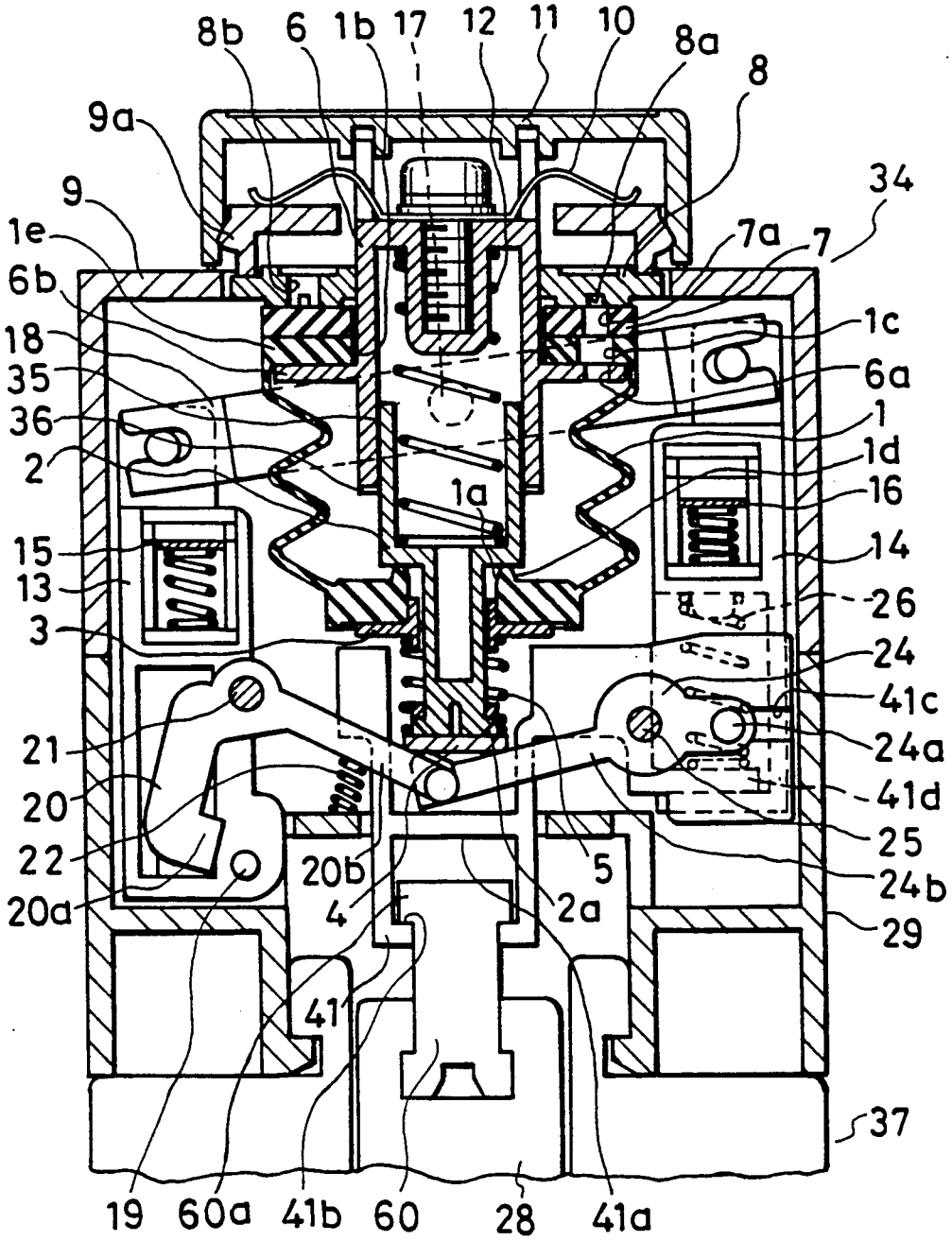
Figure 9:
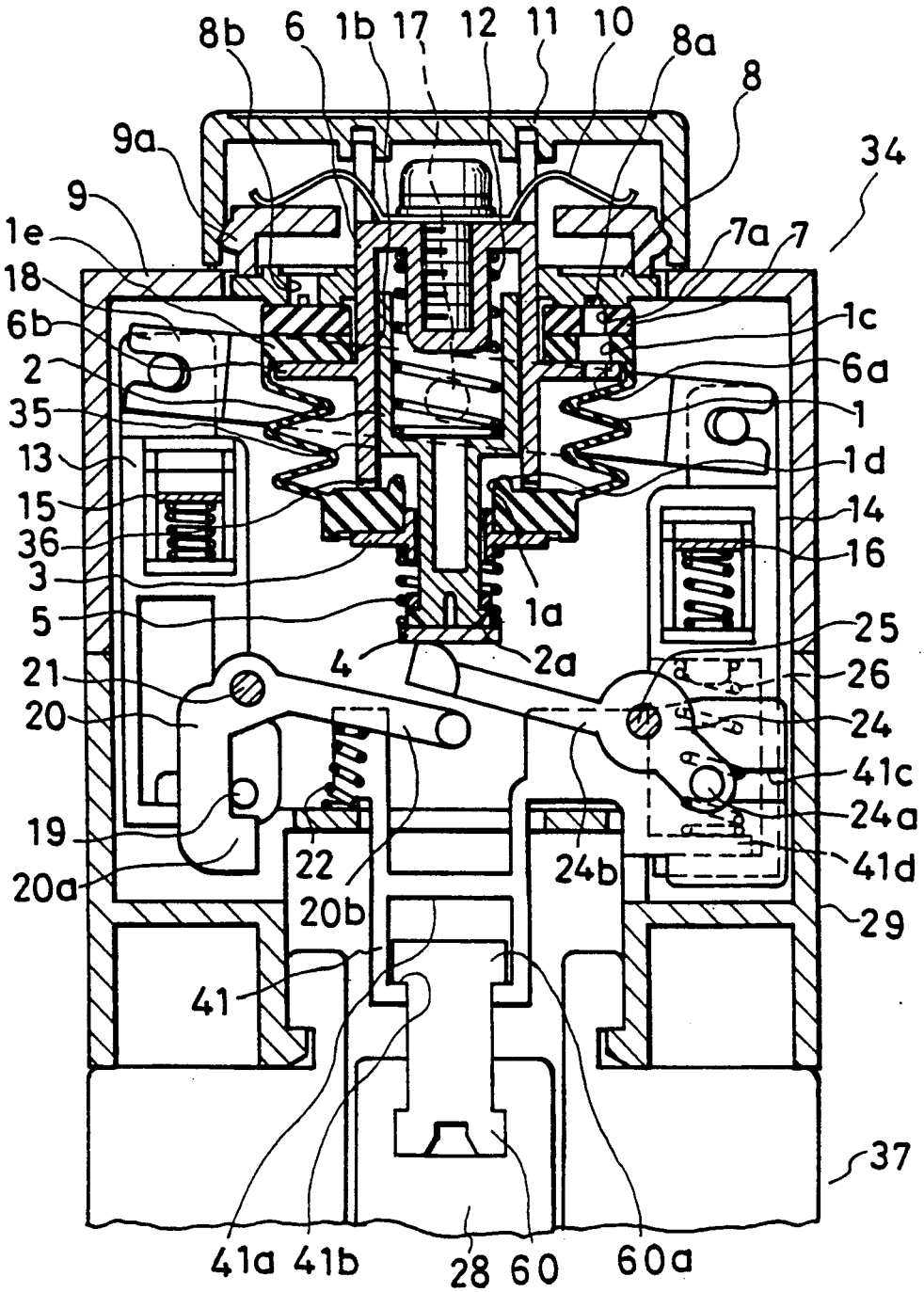

FIG. 7 is a cross-sectional side view showing a time delay unit 34 in a drop-away condition at the stage before the main relay unit 37 of the electromagnetic apparatus is actuated. FIG. 8 is a cross-sectional side view showing a time delay unit 34 in a setting operation when a connecting bar 30 is slid for a predetermined interval by the actuated main relay unit 37. FIG. 9 is a cross-sectional side view showing a time delay unit 34 in a setting operation when a main relay unit 37 has finished the setting operation shown in FIG. 8. Corresponding parts and components to the first embodiment are shown by the same numerals and marks, and the description thereon made in the first embodiment similarly apply. Differences and features of this second embodiment from the first embodiment are as follows.

An end part of a connecting bar 60 is detachably engaged to an actuator 28 of the main relay unit 37. The connecting bar 60 which is made of synthetic resin is linked to the actuator 28, which is operated by the actuated main relay unit 37. The other end part of the connecting bar 60 has an arm 60*a* (i.e. a second moving member) which is formed in a T-shape as shown in FIG. 7. The arm 60*a* is detachably engaged to a movable frame 41. The movable frame 41 which is made of synthetic resin is communicated to an air chamber of the bellows 1 for a time delay operation, and to the electric contact parts. The movable frame 41 has a wall 41*a* (i.e. a first moving member) which is contacted with an end face of the arm 60*a*, and a wall 41*b* facing a stepped face 60*b* of the arm 60*a* as shown in FIG. 7. The wall 41*b* is positioned apart from the stepped face 60*b* of the arm 60*a* having a predetermined interval L. Further, the movable frame 41 has a narrow aperture 41*c* and the arm 41*d* which is contacted with the crossbar 14.

Next, operation of the above-mentioned time delay unit 34 of the second embodiment is described.

In FIG. 7, the main relay unit 37 is kept in a drop-away condition. The connecting bar 60 is held by the actuator 28 of the main relay unit 37 at the upper position. The movable frame 41 is lifted by the arm 60*a* which contacts the wall 41*a* of the movable frame 41.

In FIG. 8, the actuator 28 of the main relay unit 37 is in a condition when the actuator 28 has been moved for the predetermined interval L between the stepped face 60*b* of the connecting bar 60 and the wall 41*b* of the movable frame 41. When the actuator 28 and the connecting bar 60 are moved downward, the stepped face 60*b* of the connecting bar 60 abuts the wall 41*b* of the movable frame 41. However, the movable frame 41 is kept in the same position as before as shown in FIG. 7.

In FIG. 9, the main relay unit 37 is in the state of finishing the setting operation and becoming in a holding condition. The actuator 28 and the connecting bar 60 are further moved downward beyond the position shown in FIG. 8. The stepped face 60*b* of the connecting bar 60 presses the wall 41*b* of the movable frame 41 in a manner to move it downward, and finally holds the frame 41 at a lower position as shown in FIG. 9. As shown in FIG. 9, when the latch pin 19 engages with the latch lever 20, the setting operation finishes.

The following is an explanation of the time delay operation of the time delay unit 34, from the main relay unit 37 in a drop-away condition when an electro-magnet coil of the main relay unit 37 has deenergized, until the time delay operation has finished.

Figure 10A:
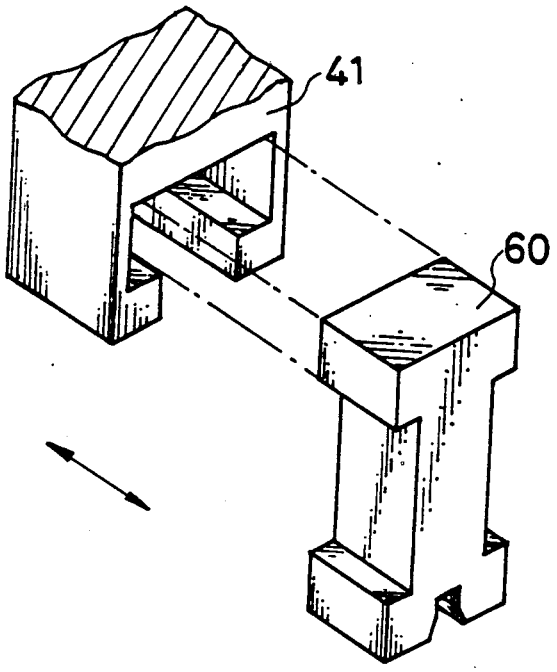
Figure 10B:
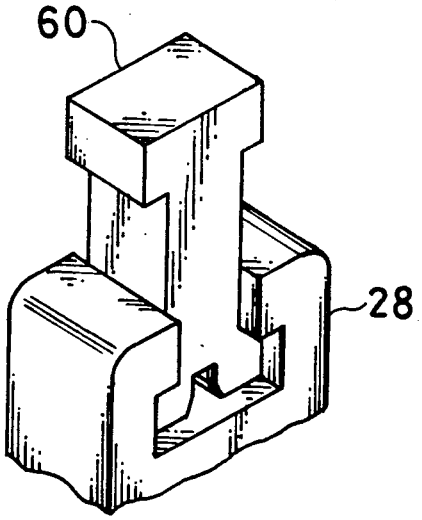
Figure 10C:
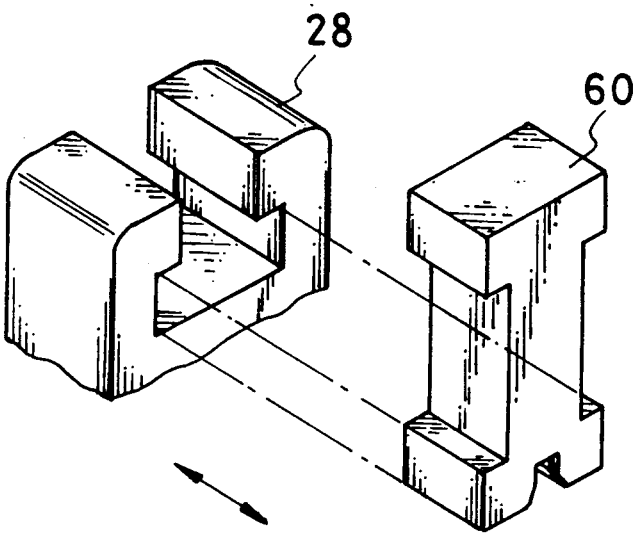

Each of the actuator 28, the connecting bar 60 or the movable frame 41 is conducted in reverse movement to the above-mentioned setting operation. Namely, the actuator 28, the connecting bar 60 and the movable frame 41 are returned from that of FIG. 9 through FIG. 8 to the position same as shown in FIG. 7. The time delay operation of the air chamber of the bellows 1 and the electric contact parts have been finished when the condition of the time delay unit 34 is shifted to the condition shown in FIG. 7 from FIG. 9. In case where the time delay unit 34 of this embodiment is intended to be mounted on other main relay unit having a different operation stroke, the movable frame 41 can be moved for the constant interval by changing only the size of the connecting bar 60, namely, by changing the interval L between the other connecting bar and the movable frame 41. FIG. 10(*a*) shows the directions for installing and removing the connecting bar 60 to the movable frame 41 in the second embodiment. The connecting bar 60 is previously provided in the time delay unit 34. FIG. 10(*b*) and 10(*c*) shown the direction for assembling the connecting bar 60 to the actuator 28 when the time delay unit 34 is mounted on the main relay unit 37.

In the second embodiment, the connecting spring used in the first embodiment need not be used. Therefore, there is no need to fear the deterioration of the spring after a long time. Since the time delay unit 34 can provide a steady operation for a long time. The stroke adjusting adapting means in the second embodiment is constructed by the first and second moving members, wherein the stroke of the actuator 28 is adapted to move the movable frame 41 a proper amount.

THIRD EMBODIMENT

Figure 12:
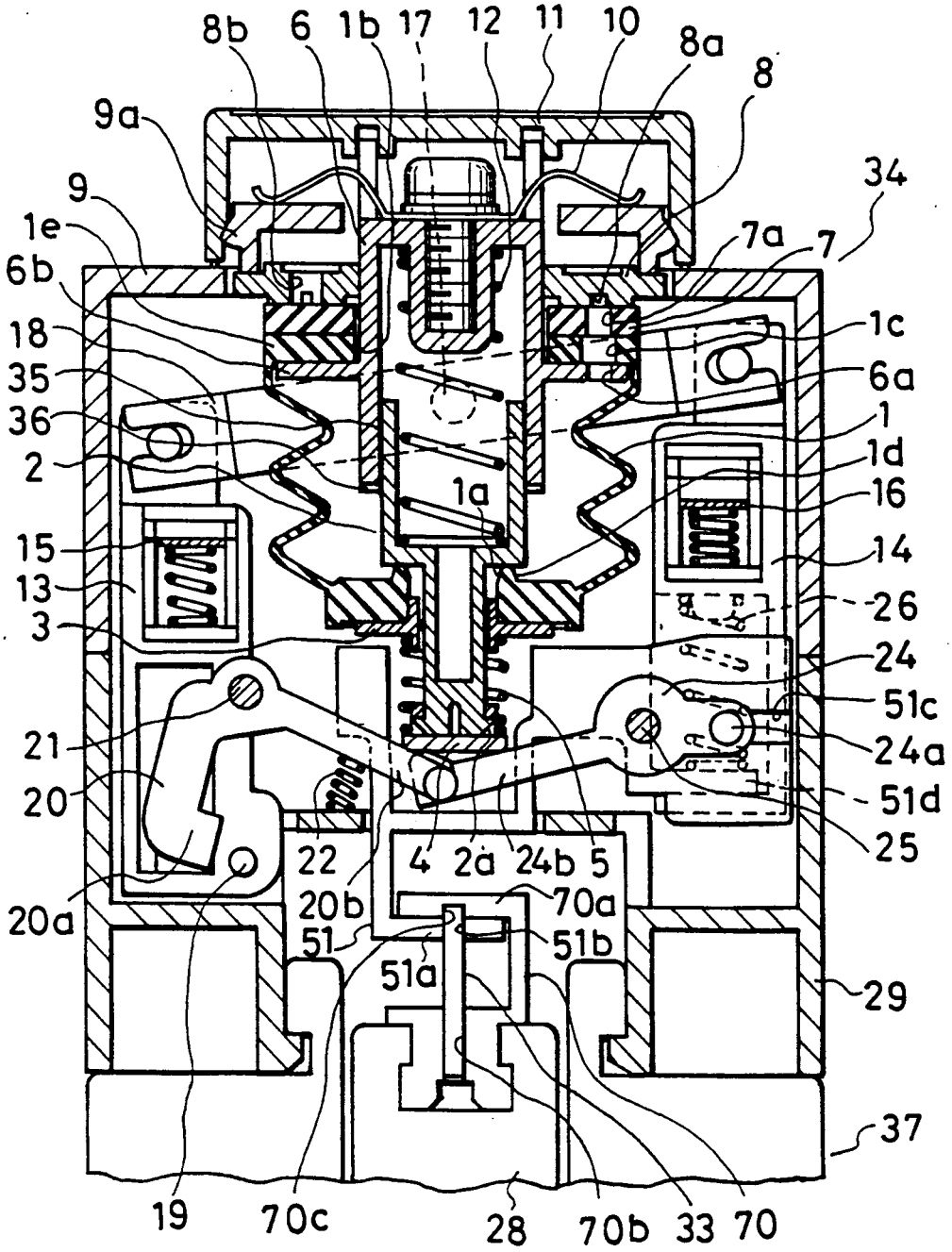
Figure 13:
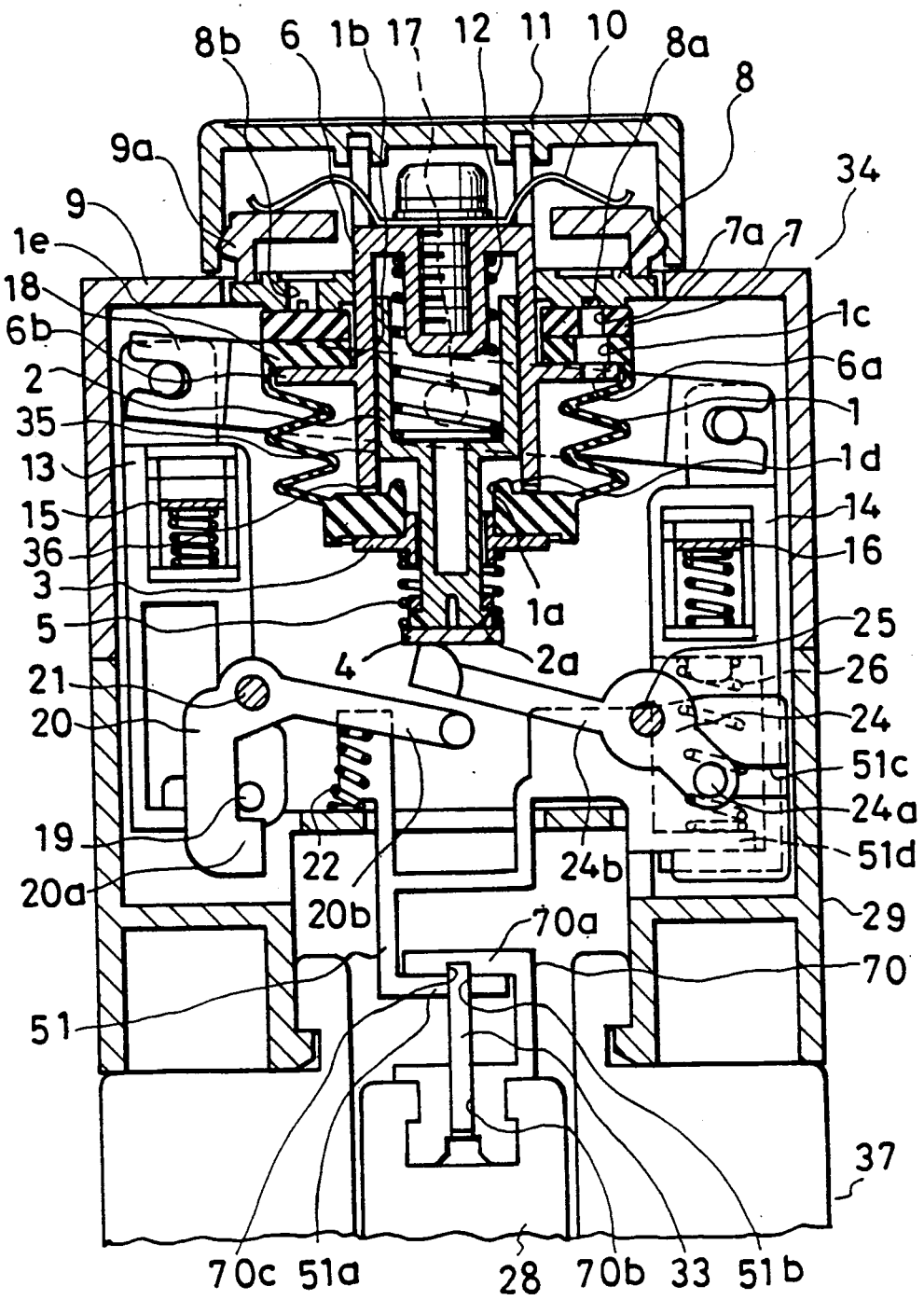

Next, the third embodiment of the present invention is described with reference of FIG. 11 to FIG. 13.

Figure 11:
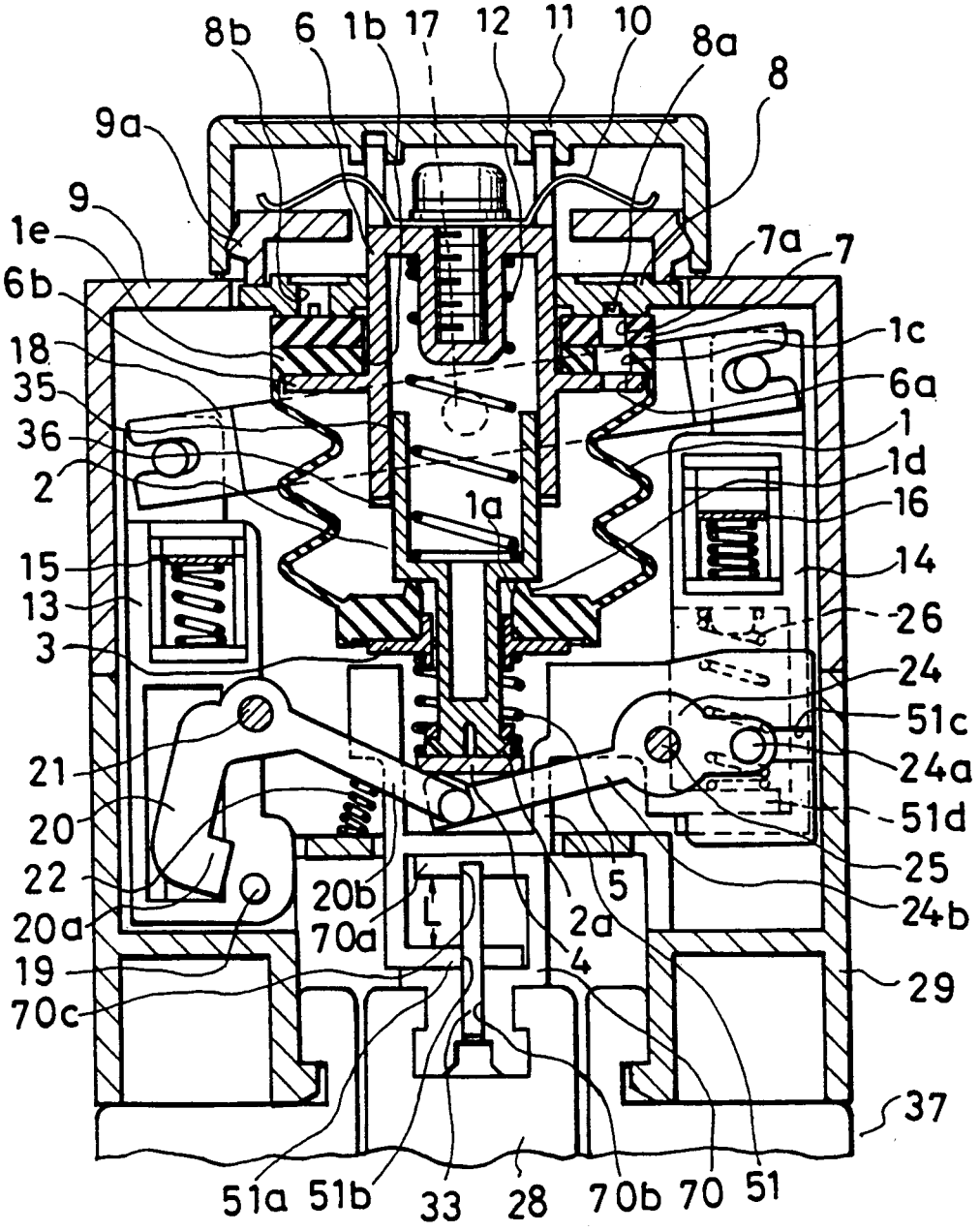
FIGS. 11 to 13 show a third embodiment of an electromagnetic apparatus of the present invention.

FIG. 11 is a cross-sectional side view showing the time delay unit 34 in a drop-away condition before the main relay unit 37 of the electromagnetic apparatus is actuated. FIG. 12 is a cross-sectional side view showing the time delay unit 34 in a setting operation when a connecting bar slides for a predetermined interval by the actuated main relay unit 37. FIG. 13 is a cross-sectional side view showing the time delay unit 34 in a setting operation when the main relay unit 37 has finished the setting operation shown in FIG. 12. Corresponding parts and components to the first embodiment are shown by the same numerals and marks, and the description thereon made in the first embodiment similarly apply. Differences and features of this third embodiment from the first embodiment are as follows.

An end part of a connecting bar 70 is detachably engaged to an actuator 28 of the main relay unit 37. The connecting bar 70 which is made of synthetic resin with an elasticity is linked to the actuator 28, which is operated by the actuated main relay unit 37. The end part of the connecting bar 70 which is engaged with the actuator 28 has a through-hole 70*b*. The other end part of the connecting bar 70 has an arm 70*a* (i.e. a second moving member) which is formed in a U-shape as shown in FIG. 11. The other end part of the connecting bar 70 has a recess 70*c* on the arm 70*a*. A movable frame 51 which is made of synthetic resin is connected to the bellows 1 for time delay operation of the air chamber, and the electric contact parts. The movable frame 51 has a first arm part 51*a* (i.e. a first moving member) which is formed a U-shape. The first arm part 51*a* which can be engaged with the arm 70*a* is positioned to face the arm 70*a* through the interval L as shown in FIG. 11. The lower end part of the first arm part 51*a* which is engaged with the actuator 28 has a through-hole 51*b*. The movable frame 51 comprises the first arm 51*a*, a narrow aperture 51*c* and a second arm part 51*d* to be engaged with a crossbar 14. A slide bar 33 which is made of metal is provided to stably slide the connecting bar 70 to the movable frame 51. The slide bar 33 is disposed in the through-hole 70*b* of the connecting bar 70, the through-hole 51*b* of the first arm part 51*a*, and recess 70*c* of the arm 70*a*. The slide bar 33 is closely fixed to the through-hole 70*b* to prevent coming off.

Next, operation of the above-mentioned third embodiment of the time delay unit 34 in the electro-magnetic apparatus is described.

The operation of the movable frame 51 and the connecting bar 70 correspondence with the driving actuator 28 of the main relay unit 37 is similar to that of the aforementioned second embodiment.

In the third embodiment, through the connecting bar 70 is moved for the same interval as the actuator 28 which is linked with the connecting bar 70, the movable frame 51 can slide for the predetermined interval which is shorter than the operation stroke of the actuator 28. As the slide bar 33 is tightly inserted to the through-hole 70*b* for fixing to the connecting bar 70, the slide bar 33 does not come off on the operation time. Further, in the third embodiment, the end of the slide bar 33 is contacted with the bottom of the recess 70*c*, and the other end of the slide bar 33 is stopped by the actuator 28. As a result, the slide bar 33 is prevented to fall from the connecting bar 70 absolutely.

In the third embodiment, the connecting bar 70 is very smoothly slid to the movable frame 51, since the movable frame 51 slides on the smooth slide bar 33 which is made of metal. And, this slide operation is stably continued for a long time because of using the rigid slide bar 33.

In the third embodiment, when the time delay unit 34 is mounted on the main relay unit 37, the connecting bar 70 which is mounted on the time delay unit 34 can be slid to engage with the actuator 28 of the main relay unit 37 similarly to the first and the second embodiments. Therefore, installing and removing the time delay unit 34 in assembly operation is simple.

Further, in the third embodiment, since the connecting bar 70 is accurately provided at the movable frame 51 of the time delay unit 34 by the engage bar 33, it is more easy to mount the time delay unit 34 on the main relay unit 37. The stroke adjusting adapting means in the third embodiment is constructed by the first and second moving members, wherein the stroke of the actuator 28 is adapted to move the movable frame 51 a proper amount.

In the aforementioned embodiments, the difference of strokes between the actuator 28 and the movable frame 31, 41 and 51 are not problem, since the actuator 28 of the main relay unit 37 is moved in a very high speed, such as several meter/sec. in the operation and there is no need of considering the delay operation time of the electric contact parts. In the aforementioned embodiments, as the time delay operations use the air flow resistance in the groove, the delay is caused by using such mechanism, such as the mechanical delay of 100 millisecond to 180 millisecond. Accordingly, the delay of the operation time for using the interval is of no problem in the time delay operation.

In the aforementioned embodiments, though the mechanism of the present invention is provided to the time delay unit 34, the mechanism can be applicable to an electromagnetic apparatus, wherein an auxiliary contact unit is detachably mounted a magnetic contactor and a crossbar of the auxiliary contact unit is operated by an actuator of the magnetic contactor.

Apart from the above-mentioned second and third embodiments, wherein the difference of the operation stroke between the actuator and the movable frame is adjusted by the interval between the connecting bar and the movable frame, a modified embodiment may be such that the difference can be absorbed by an interval between a connecting bar and an actuator.

As aforementioned, in the present invention, when the actuator of the electromagnetic apparatus is moved over the operation stroke range of the movable frame, the difference of the length is adjusted by the interval between the connecting bar and the movable frame, or the actuator. Accordingly, the plural electromagnetic apparatus having the difference operation stroke, respectively, can be kept up with only one kind of mechanism of the present invention.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. An electromagnetic apparatus comprising:

a main body having an actuator which is magnetically operated; and a contact unit which is detachably mounted to said main body, and which includes (a) contact means, (b) a movable body which is moved by said actuator and which operates said contact means in a predetermined opening or closing operation, and (c) a connecting member for connection between said actuator and said movable body, one end of said connecting member being detachably engaged with said actuator and an other end of said connecting member being connected to said movable body through stroke adapting means, said stroke adapting means adapting a stroke of said actuator to thereby move said movable body a proper amount.

2. An electromagnetic apparatus in accordance with claim 1, wherein said stroke adapting means includes a first spring receiving member which is connected to said movable body, a second spring receiving member which is connected to said connecting member, and a spring which is provided between said first spring receiving member and said second spring receiving member.

3. An electromagnetic apparatus in accordance with claim 1, wherein said stroke adapting means includes.

a first moving member which is connected to said movable body, and a second moving member which is connected to said actuator and which is movable with respect to said first moving member over a predetermined moving interval, and a slide bar which is fixed to said second moving member and which extends slidably through a hole in said first moving member.

4. An electromagnetic apparatus in accordance with claim 1, wherein said stroke adapting means includes a first moving member which is connected to said movable body, a second moving member which is connected to said actuator and which is movable with respect to said first moving member over a predetermined moving interval, and a slide bar which is fixed to said second moving member and which extends slidably through a hole in said first moving member.

* * * * *